US010641580B2

(12) United States Patent
Moran et al.

(10) Patent No.: US 10,641,580 B2
(45) Date of Patent: May 5, 2020

(54) WEAPON

(71) Applicants: Aviad Moran, Kiryat Ono (IL); Akiva Eliash, Tel Aviv (IL)

(72) Inventors: Aviad Moran, Kiryat Ono (IL); Akiva Eliash, Tel Aviv (IL)

( * ) Notice: Subject to any disclaimer, the term of this patent is extended or adjusted under 35 U.S.C. 154(b) by 238 days.

(21) Appl. No.: 15/925,834

(22) Filed: Mar. 20, 2018

(65) Prior Publication Data

US 2018/0274881 A1 Sep. 27, 2018

(51) Int. Cl.
*F41B 15/02* (2006.01)
*F41H 9/10* (2006.01)
*F41B 15/04* (2006.01)

(52) U.S. Cl.
CPC ..... *F41B 15/027* (2013.01); *F41B 15/022* (2013.01); *F41B 15/04* (2013.01); *F41H 9/10* (2013.01); *F41B 15/02* (2013.01)

(58) Field of Classification Search
CPC ..... F41B 15/02; F41B 15/022; F41B 15/04
USPC ..... 463/47.2, 47.3, 47.7
See application file for complete search history.

(56) References Cited

U.S. PATENT DOCUMENTS 4,719,534 A * 1/1988 Ward ..... A01K 15/021 361/232
4,819,137 A * 4/1989 Hamilton ..... F41B 15/025 362/102
4,884,809 A * 12/1989 Rowan ..... F41B 15/04 463/47.3
4,893,815 A * 1/1990 Rowan ..... F41B 15/04 42/1.08
5,041,951 A * 8/1991 Fan ..... F41B 15/04 362/102
5,529,300 A * 6/1996 Frazier ..... F41B 15/02 124/56
6,231,447 B1 * 5/2001 Pelkey ..... F41B 15/027 403/368
6,238,292 B1 * 5/2001 Pelkey ..... F41B 15/027 403/368
6,963,480 B2 * 11/2005 Eccles ..... F41H 13/0018 361/232
7,316,621 B2 * 1/2008 Tufts ..... F41B 13/10 119/801
7,421,933 B1 * 9/2008 Pearson ..... F41H 13/0018 361/232
7,488,255 B2 * 2/2009 Labes ..... F41B 15/027 135/75
8,721,459 B2 * 5/2014 Pelkey ..... F41B 15/027 463/47.7
2002/0163799 A1 * 11/2002 Kukuk ..... F21V 33/0064 362/102

* cited by examiner

*Primary Examiner* — Chase E Leichliter

(57) ABSTRACT

An extendable, telescoping multi-purpose baton that holds one or more tools in such a way that a user can use the baton and another tool at the same time while at least one hand remains free. The baton is extended by a propulsion mechanism permitting controlled speed and force of extension. The telescoping mechanism may be electrically or pneumatically operated and can be extended with sufficient speed and force to deliver a blow or jab when impacting the target, at a distant significantly longer than the user's arm length, permitting use from a safe distance.

20 Claims, 8 Drawing Sheets

WEAPON

RELATED APPLICATION

This application claims the benefit of priority under 35 USC § 119 of Israel patent application no. 251324 filed on 21 Mar. 2017, the contents of which are incorporated herein by reference in their entirety as if fully set forth.

FIELD OF THE INVENTION

The present invention relates to weapons, in general and, in particular, to a multi-purpose weapon.

BACKGROUND OF THE INVENTION

Policemen and other law enforcement, security and military personnel typically carry a number of weapons and tools on their person. These can include a hand gun, a baton, a flashlight, a mace can, an electric shocker, a laser pointer, etc. Batons are used for crowd control or the dispersal of belligerent people, as well as rescuing trapped individuals by breaking windows or doors.

There are two main disadvantages with the current baton. First, the length of the baton is limited, so that it can be carried conveniently on a belt or other easily accessible location. However, this means that the personnel must come into close contact with the individuals to be hit, subdued or moved aside. And second, the user would typically use one hand for using the baton and thus he can use only one other tool at the same time, since if more than one of these tools or weapons is used simultaneously, typically the user must hold one tool in each hand, so neither hand is free for any other activity.

There are known expandable telescopic batons that are manually expandable by the user. They include a telescopic rod that can be used to hit an assailant by manually extending it and hitting or jabbing him with it.

There are also known electroshock weapons, such as Tasers, for subduing a person from a distance of several meters. These Tasers include a cartridge which holds a pair of small, dart-like electrodes, coupled by conductors to the main unit. When these dart-like electrodes are fired towards a target, they lodge in the target and deliver electric current to the target to disrupt voluntary control of the muscles. Each time the user wishes to use the Taser, he must first insert a fresh cartridge. There are also known non-Taser stun guns or electro-shock weapons that deliver an electric shock aimed at temporarily disrupting muscle functions and/or inflicting pain without causing significant injury. Many types of these devices exist. Stun guns, batons (or prods), and belts administer an electric shock by direct contact, whereas Tasers (conducted electrical weapons) fire projectiles that administer the shock through thin flexible wires. Long-range electroshock projectiles, which can be fired from ordinary shotguns and do not need the wires, have also been developed.

Accordingly, there is a long felt need for a weapon that is compact for carrying but can be used effectively at a distance from the user, and it would be very desirable if the weapon was designed to permit simultaneous use of more than one tool or weapon while leaving at least one of the user's hands free.

SUMMARY OF THE INVENTION

The present invention relates to an extendable, telescoping multi-purpose baton that holds one or more tools in such a way that a user can use the baton and another tool at the same time while at least one hand remains free. The baton is extended by a propulsion mechanism permitting controlled speed and force of extension. According to preferred embodiments of the invention, the telescoping mechanism is an electrically actuated mechanical mechanism and the baton, itself, can be extended with sufficient speed and force to deliver a blow or jab when impacting the target, at a distant significantly longer than the user's arm length, permitting use from a safe distance. According to preferred embodiments of the invention the length of extension of the baton, the speed and force of the extension are controlled either automatically or by the user as desired. These capabilities provide, easier, safer and more controlled management of violent persons and crowds. According to embodiments of the invention, an electric shocker is disposed in the baton wherein its electrodes are mounted at the outermost end of the baton, permitting delivery of one or several repeated electric shocks beyond the range of the user's own arm and without the need to replace a cartridge, as is required by Tasers, or any other component of the shocker.

Thus, the weapon of the present invention can repeatedly deliver a blow or jab at a distance from the user and at a controlled force. It can jab, deliver an electric shock, dispense mace or tear gas, all of these operations repetitiously, simultaneously or one at a time, and all from a safe distance, and then retract the weapon for operating again and/or for easy handling and carrying.

There is provided, according to the present invention, a weapon including a housing, a telescopic rod formed of a plurality of telescopically interconnected rod segments mounted in the housing, where an innermost segment of the rod segments including a replaceable end member having an impact surface. The weapon also includes a guide collector, mounted adjacent a distal end of the weapon, and a guide member coupled at one end thereof to the guide collector and at its other end to the innermost rod segment. A propulsion drive mechanism is mounted in the housing, for controllably extending and retracting the guide member and thereby the telescopic rod towards a target at a distance.

According to some embodiments, the propulsion drive mechanism includes a motor and the weapon further includes a controller for controlling the motor and, in turn, the speed and force of extension and retraction of the telescopic rod.

According to some embodiments, the weapon further includes at least one weapon or tool selected from the group including: a knife, brass knuckles, a canister of mace, mustard gas or tear gas, an electroshock weapon, an illumination tool, a flashlight or a laser pointer, and a camera.

According to some embodiments, the weapon further includes an electric power source mounted in the housing, a capacitor coupled to the electric power source, and two electrodes disposed at the impact surface of the end member and selectively electrically coupled to the capacitor. When the capacitor is connected to the electrodes and the electrodes touch a target, an electric circuit is closed thereby discharging the capacitor through the target.

The weapon may further include a pressure sensor mounted in the impact surface to cause the telescopic rod to retract when a pre-defined pressure on the impact surface is reached.

There is further provided, according to the invention, a method for providing an impact, the method including actuating a drive mechanism to propel a telescopic rod, formed of a plurality of telescopically interconnected rod segments, by means of a guide member, where one end of the guide member is coupled to an innermost rod segment of the telescopic rod and a second end of the guide member is coupled to a guide collector, controlling speed and force of propulsion of the guide member, and delivering an impact by an end member coupled to the innermost rod segment of the telescopic rod.

Preferably, the method also includes retracting the innermost rod segment and the telescopic rod and collecting the guide member on the guide collector.

According to embodiments of the invention, the method may include delivering a jab by the impact surface of the end member. Alternatively, the method may include connecting a capacitor to a pair of electrodes mounted in the end member, and touching the electrodes to a target, thereby closing an electric circuit and discharging the capacitor through the target and delivering an electric shock.

Preferably, these embodiments further include recharging the capacitor after each shock, so that a plurality of shocks can be delivered in a short time.

BRIEF DESCRIPTION OF THE DRAWINGS

The present invention will be further understood and appreciated from the following detailed description taken in conjunction with the drawings in which.

DETAILED DESCRIPTION OF THE INVENTION

The present invention relates to an extendable weapon. In particular, the extendable weapon is a telescoping baton on or in which are mounted one or more additional tools, such as an electric shocker, a flashlight, a laser pointer, a canister of tear gas or other gas, etc. A removable and replaceable end member is mounted on the innermost telescoping section of the baton (which reaches the furthest when the baton is extended). The end member can be configured to deliver a jab or an electric shock to a target or can hold another weapon or tool. Several tools or weapons can be mounted in the baton at one time. Alternatively, or in addition, the end member can be replaced by another end member holding a specific tool or tools, depending upon the additional tool or weapon to be utilized. In this way, a user can use the baton and another tool at the same time. Alternatively, a user can hold and actuate the baton and another tool mounted therein in one hand, while his or her other hand remains free. Propelled rapid extension of the baton permits repeated delivery of a punch, electric shock, gas etc., to a distance beyond the length of the user's arm, permitting repetitious action at a distance.

According to preferred embodiments of the invention, the baton is electrically actuated and can be extended with sufficient speed and force to deliver a blow or jab when impacting the target, at a distant significantly longer than the user's arm length, permitting use from a safe distance. The length of expansion of the baton, the speed and force of the expansion can be controlled either automatically or by the user as desired.

Figure 1:
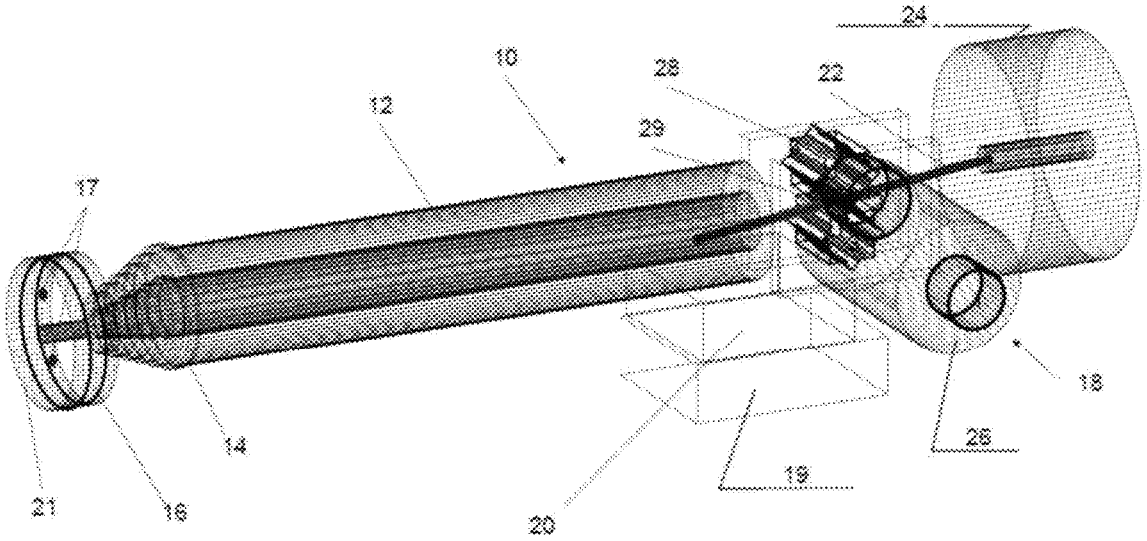
FIG. 1 is a schematic isometric view of a baton constructed and operative in accordance with alternative embodiments of the present invention in a retracted orientation.

Referring now to FIG. 1, there is shown a schematic illustration of an extendable weapon 10, here shown as a telescopic cylindrical baton, constructed and operative in accordance with embodiments of the present invention. Weapon 10 includes a telescopic cylindrical rod 12, formed of a plurality of telescopically interconnected rod segments 14. Telescopic rods are well known. They typically include a cylindrical outer shaft containing telescoping inner shafts that lock onto each other by various well known conventional means, when fully expanded. The shafts are usually made of steel, but lightweight telescopic rods may have their shafts made from other materials, such as aluminum alloy. Other materials, such as carbon fibers, carbyne, graphite, etc., can also be utilized in the present invention. While the rod must be sufficiently strong to deliver a jab without folding, it can be formed of a relatively hard and lightweight material. It will be appreciated that, because of the force created by propulsion of the baton to impact the target at a selected force, the baton need not be heavy, as are conventional batons, which rely mainly on their weight to provide the force.

In practice, weapon 10 would be mounted in a housing (not shown) including an outwardly extending, open ended outer tube for housing the rod segments 14 of the telescoping rod 12. A controlled propulsion drive mechanism 18, for extending and retracting the telescopic rod by means of a guide member 22, is also provided. It will be appreciated that, although one type of drive mechanism is illustrated, alternatively, any other appropriate propulsion drive mechanism, which is adapted and configured for rapid, controlled pushing and pulling of the guide member, can be utilized.

Guide member 22 is coupled at one end to a guide collector 24, adjacent the distal end of the weapon, and at its other end to the innermost rod segment of the telescopic rod 12, which includes an end member 16 having an impact surface or cushion 21. Guide member 22 is moved through drive mechanism 18 that propels it outwardly in such a way that it rapidly pushes the innermost rod segment 14 of the telescopic rod 12 outwards from the segment in which it is seated. Once it is fully extended and locked to the segment in which it is seated, that rod segment, in turn, pulls and extends the segment in which it is seated and, in this way, each of the rod segments 14 locks to and pulls the segment it is seated in, one after the other until telescopic rod 12 is fully extended. In order to perform this function, the guide member 22 must be suitably stiff or rigid so that it does not fold or collapse while being propelled by the drive mechanism. Yet, it is formed of a thickness that permits it to spool around the guide collector even though it is formed of such stiff or rigid material. Guide member 22 can be formed, for example, of dense plastic or metal, a steel ribbon, or so-called "fish tape", which is a long, thin, flat steel wire wound up inside a donut-shaped wheel with a sturdy handle. Preferably, guide member 22 is formed of carbon. This guide member is found in each of the embodiments of the invention. Guide member 22 may have a cylindrical, flat or any other suitable cross section.

Drive mechanism 18 includes a motor 26 coupled, as by a transmission (not shown), to a pair of gear wheels 28, 29. Motor 26 can be an electric motor, for simplicity of design and ease of maintenance, or a step motor, a pneumatic motor or any other suitable motor. Guide member 22 passes between the gear wheels, which include a trough-like channel formed between them that is sized to frictionally engage the guide member so as to propel it in and out of the guide collector, depending on the direction of rotation of the gear wheels. Activation of the motor 26 causes guide member 22 to unwind from or wind onto guide collector 24 and to push or pull the innermost segment of rod segments 14, thereby selectively extending or retracting the telescopic rod 12.

A controller 20 is provided for controlling the motor and, in turn, the speed and force of extension and retraction of the telescopic rod, as well as controlling operation of any other tools mounted in the housing of the telescopic rod, or in housing 21 or on jabbing surface 16. The controller can be connected to the motor wirelessly, as by Bluetooth technology, or in any other fashion. According to some embodiments, electric wires (not shown) are provided in the housing, or embedded in the guide member, to carry control signals from controller 20 to one or more tools as described herein mounted in the housing of the telescopic rod, or in housing 21 or on jabbing surface 16. An appropriate user interface, such as one or more buttons or switches, is provided for a user to control the controller which actuates and stops the operation of the tools it controls. A power source 19, such as a battery, is provided and configured to provide power to the motor 26 and the other electrical components of the weapon 10.

The telescopic rod 12, particularly the end member 16, preferably is configured to receive one or more additional weapons or tools (not shown) mounted therein or thereon, such as a knife, brass knuckles, a canister of tear gas, a shocker or shocker electrodes or other electroshock weapon, etc. In this way, extension of the telescopic rod causes the weapon to reach the desired target while the user is distanced from the target. Preferably, the telescopic rod 12 is extended with sufficient force and speed that the jabbing surface delivers a strong blow. Alternatively, or in addition, telescopic rod 12 can be configured to receive an illumination tool (not shown) mounted thereon or therein, such as a flashlight or a laser pointer. These electric tools are also operated by the user interface and the controller 20 and preferably are powered by the internal power source 19.

When the weapon includes a shocker, two electrodes 17 are provided at the impact surface 21 of end member 16. Electrodes 17 are coupled to a capacitor (not shown). The capacitor, in turn, is coupled to the battery or any other power source for continual charging. In this way, the capacitor is recharged rapidly after each shock, so that a plurality of shocks can be delivered in a short time. When the user wishes to activate the shocker, he or she activates a switch which connects the capacitor to the electrodes 17 and, when the electrodes touch the body of the target, an electric circuit is closed thereby discharging the capacitor. The electric current of the discharge flows through the target's body and creates an electric shock. The capacitance of the capacitor is selected according to the degree of electric shock it is desired to deliver to the attacker, and according to the speed at which the capacitor is to be charged. It will be appreciated that suitable insulation is provided for the conducting wires leading from the capacitor to the electrodes 17. These wires can be disposed inside the telescoping rod, through the guide member or embedded therein, or as stripes along the outer surface of the telescoping rod. When on the outer surface, the entire rod can be electrified to deliver a shock when the segments are touched, except for non-electrified areas that can be provided for holding by the user. In some embodiments, all the rod segments except for the outermost (largest diameter) rod segment that is held by the user, will be electrified.

Figure 2A:
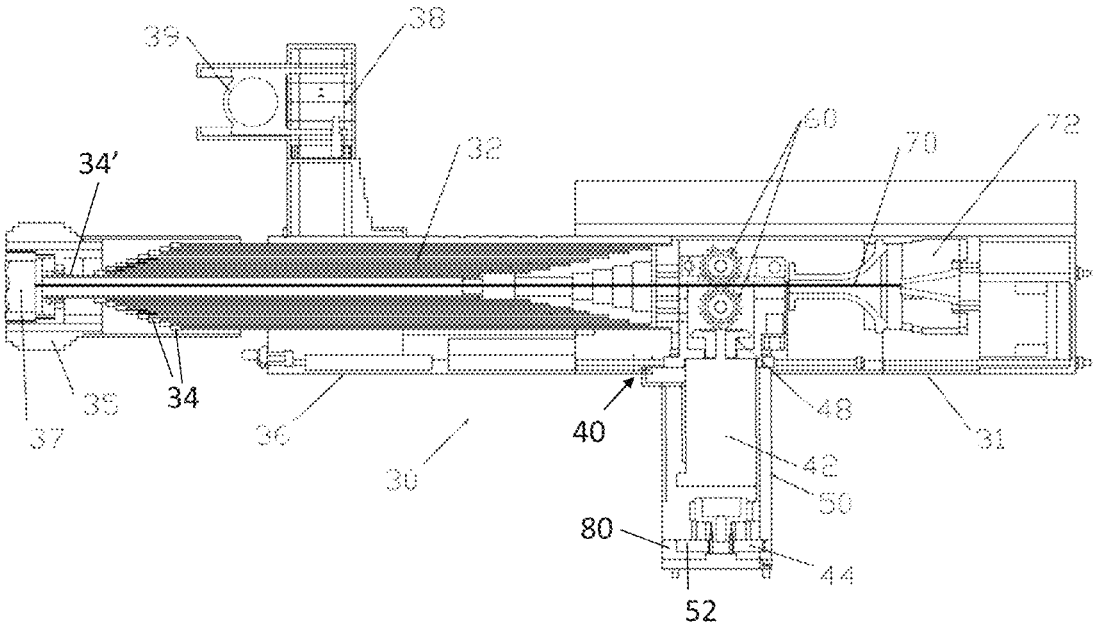
FIG. 2*a* is a schematic illustration of a baton constructed and operative in accordance with embodiments of the present invention in a retracted orientation.
Figure 2B:
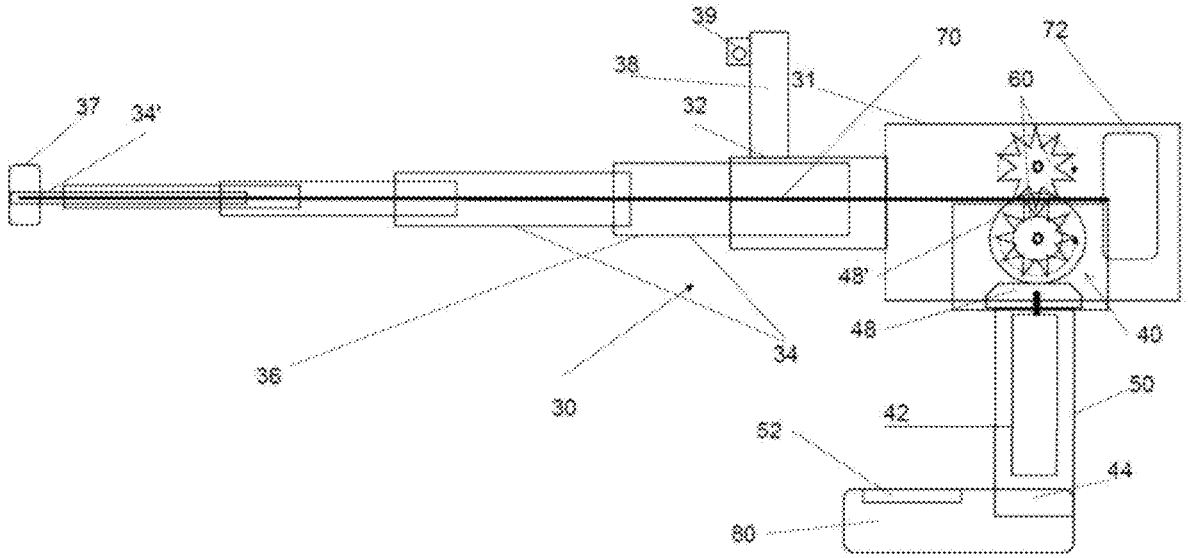
FIG. 2*b* is a schematic illustration of the baton of FIG. 2*a* in use in an extended orientation.

Referring now to FIGS. 2*a* and 2*b*, there is shown a schematic illustration of an extendable weapon, here shown as a telescopic baton 30, constructed and operative in accordance with alternative embodiments of the present invention. Baton 30 includes a housing 31. A telescopic rod 32, formed of a plurality of telescopically interconnected rod segments 34 in the form of tubes of various diameters nested into one another and locked when fully expanded, is mounted in housing 31. In the illustrated embodiment, housing 31 includes an outwardly extending, open ended barrel 36 in which telescoping rod 32 is housed. A propulsion drive mechanism 40 including a guide member 70, for extending and retracting the telescopic rod, is also mounted in housing 31.

Guide member 70, as described in detail above, is coupled at one end to a guide collector 72, adjacent the distal end of the housing, and at its other end to the innermost segment 34' of the telescopic rod, and passes through guide mechanism 40. Activation of drive mechanism 40 causes guide member 70 to unwind from or wind onto guide collector 72 and to push or pull the innermost telescopic section, to selectively extend or retract the telescopic rod.

A protruding, preferably substantially perpendicular handgrip 50 is provided, here shown extending downwardly from the housing 31. A battery 44, controller 80 and other electronics for operating the weapon may be disposed in handgrip 50 itself, or in an extension of handgrip 50. Controller 80 controls the extension and retraction of the telescopic rod, as well as the operation of any of the other tools mounted in or on the baton 30. Thus, handgrip 50 can serve also as a control column, to permit a user to control the extension and retraction of the baton, as described below. In this case, the handgrip 50 includes a user interface 52, such as one or more actuators, for example, a button or slider, such that operation thereof by the user controls the activation and operation of the controller. Alternatively, the controller 80 and battery 44 can be disposed in the rear of the housing, as shown in broken lines, or in any other suitable location.

Figure 7:
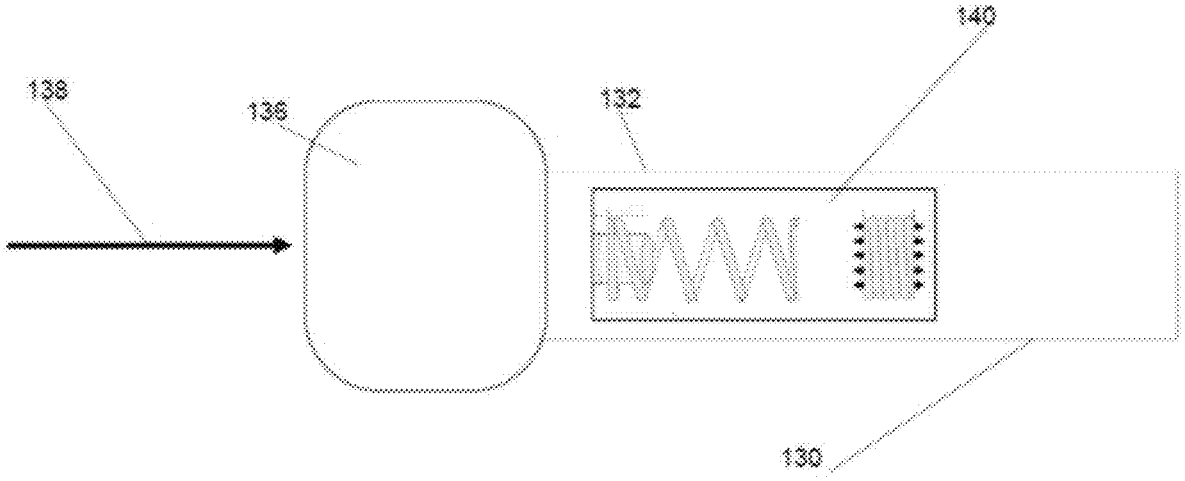
FIG. 7 is a schematic illustration of a force control mechanism constructed and operative according to embodiments of the present invention.

Telescopic rod 32 preferably is configured to receive a weapon (not shown) mounted thereon or therein, such as a knife, brass knuckles, a canister of tear gas, an electric shocker or other electroshock weapon, etc. For example, the weapon can be mounted on or in the end member 35, which can be configured with a jabbing or impact surface, such that extension of the telescopic rod causes the weapon to engage the desired target. Preferably, the telescopic rod 32 is extended with sufficient speed and force to deliver a strong blow to the target. This would permit a user to attack or defend against one or more attackers, for example, from a distance of some 3.5 meters, extending the baton to jab with the power of some 80 Kg. See, for example, FIG. 2*b*, showing the telescopic rod 32 fully extended. On the other hand, as shown in one example described below with reference to FIG. 7, in order not to injure a person jabbed by the extending rod, one or more springs can be mounted in end member 136 with a pressostat or other pressure sensor that would cause the motor to operate in the reverse direction when a pre-defined pressure on the outer edge of the impact surface 138 is reached.

Alternatively, or in addition, telescopic rod 32 or housing 31 can be configured to receive an illumination tool (not shown) mounted thereon or therein, such as a flashlight or a laser pointer. These electric tools are also operated by the controller 80 and preferably are powered by the internal power source 44, such as a battery.

According to any of the embodiments of the invention described herein, the segments 34 of telescopic rod 32 may be formed of carbon, or other hard, sturdy lightweight material, and includes stripes formed of a conductive material. In this case, the stripes on the rod segments can be coupled to the power source in order to electrify the telescoping rod, when the rod is extended or partially extended. The amount of current can be defined in advance or selected by the user, so as to control the level of shock. Thus, when the rod segments are touched by a target, an electrical circuit is closed and the target will receive an electric shock. This would provide protection to the user, preventing the target from getting too close or from taking the baton away from the user. It will be appreciated that suitable insulation can be provided between the conductive stripes.

Any number of possible drive mechanisms can be utilized in the present invention. One embodiment is shown in FIGS. 2*a*, 2*b*, 3*a* and 3*b*. In this embodiment, guide member 70 passes between and is frictionally engaged by adjacent hubs 62 of a pair of spur gears 60. Preferably, one of the spur gears 60 is spring loaded. In this way, when spur gears 60 rotate in opposite directions relative to one another, guide member 70 is frictionally engaged between the gears and can be propelled outwards from the housing 31 into barrel 36 or inwards back into the housing by friction between the spur gears, thereby extending or retracting the telescopic rod. Mechanical brakes (not shown) can be provided to slow down the retraction of the telescopic rod. Except for the portion extending through barrel 36, guide member 70 is configured to be releasably coiled around the guide collector 72 inside housing 31 whenever the telescopic rod is not fully extended.

In the embodiment of FIG. 2*a*, much of the drive mechanism 40 that actuates telescopic rod 32 is disposed inside handgrip 50. Drive mechanism 40 further includes a motor 42. Motor 42 can be an electric motor, for simplicity of design and ease of maintenance, or a pneumatic or other motor, and preferably motor 42 is a step motor. A power source 44, such as a battery, is replaceably mounted in the handgrip 50 and is configured to provide power to the motor 42 disposed in the handgrip 50.

Preferably, the length, speed and force of the extension and retraction of the telescoping rod can be set in advance or can be controlled by the user. Controller 80, for example, can control the number of rotations of the spur gears 60 and, thus, the length of the extension of the guide member 70 from guide collector 72 and, in turn, the extension or retraction of the telescoping rod. According to an exemplary embodiment of the invention, the spur gears 60 are driven by a step motor 42, such that the number of rotations can be accurately determined and controlled by the controller 80. According to some embodiments of the invention, a spiral torsion spring, like that in a self-retracting tape measure, is provided to retract and wind the guide member 70.

Figure 3A:
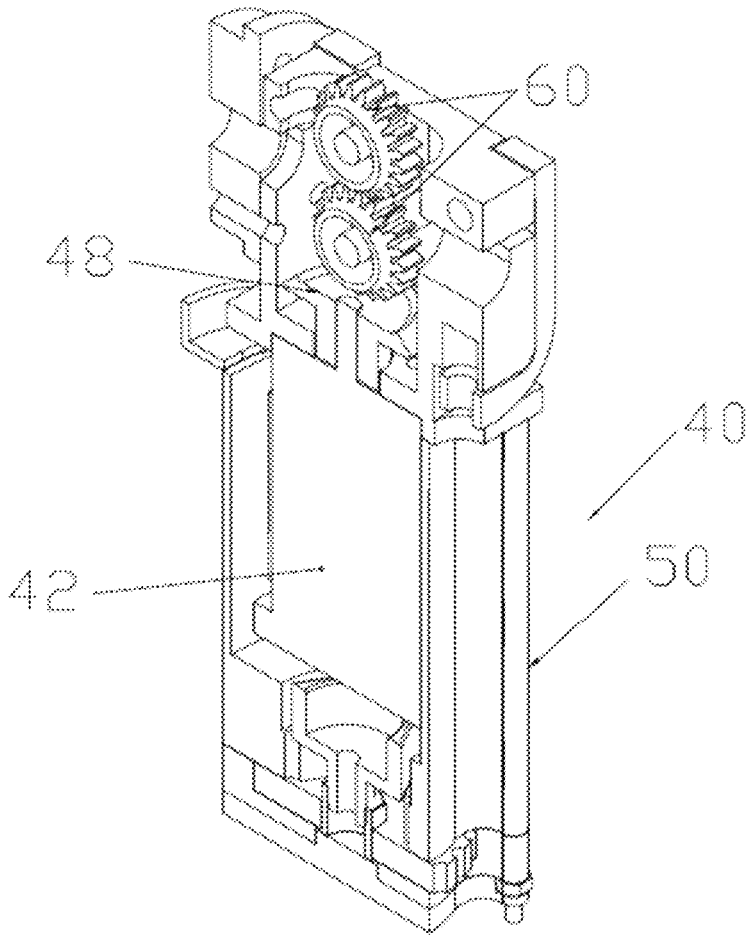
FIGS. 3*a* and 3*b* are schematic side sectional and top views of a drive mechanism according to embodiments of the invention.
Figure 3B:
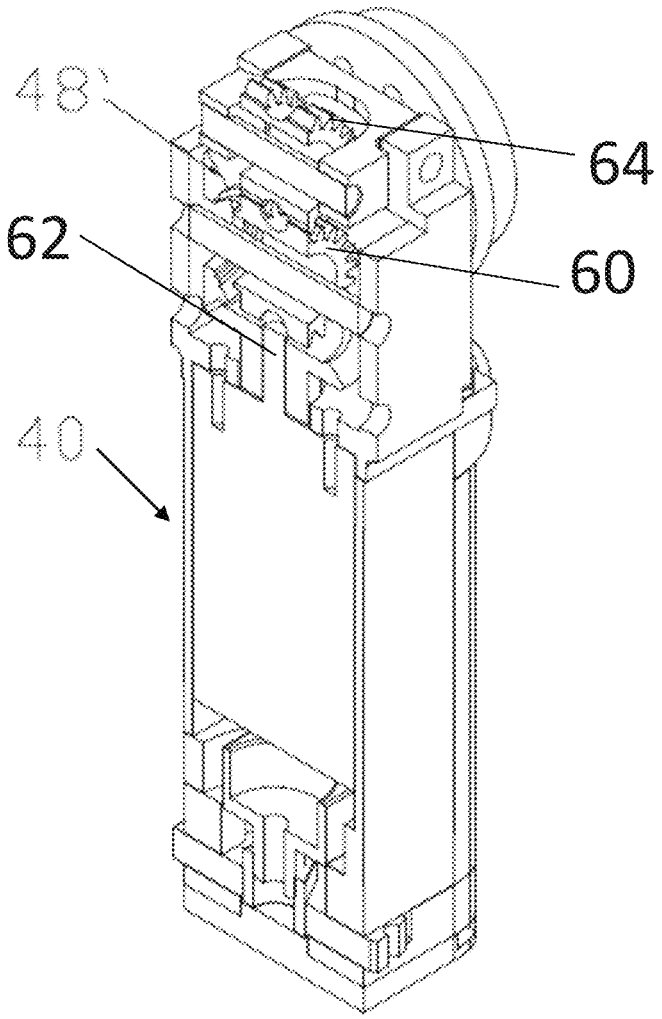

As shown schematically in FIGS. 3*a* and 3*b*, respective side sectional and top views of drive mechanism 40, motor 42 is coupled to a pair of spur gears 60, each having a hub 62 with two peripheral rings of gear teeth 64, as seen most clearly in FIG. 3*b*. Spur gears 60 are actuated by motor 42 via a transmission, here illustrated as meshed bevel gears 48, 48' mounted on shafts (not shown) disposed perpendicular to one another. It will be appreciated that spur gears 60 can be of any type, for example, frictionally mounted wheels, regular toothed gear wheels, conical gears, or belts. The guide member 70, as described above, passes through a trough between the wheels or gear wheels and is frictionally engaged between them to move the guide onto and off of the guide collector.

Referring again to FIGS. 2*a* and 2*b*, if desired, a second handgrip 38 can be provided, here shown extending upwardly from housing 31, to permit a user to grip the baton with both hands, when necessary, and hold it steady during use. Straps (not shown) with fasteners, such as hook and loop fasteners, may be provided on housing 31, preferably adjacent handgrip 38, to retain the baton on the user's forearm, thereby freeing the user's other arm, which is not required to support the weapon. In this case, a camera 39 or laser pointer or the like can be mounted on second handgrip 38 and actuated by controller 80 or by a separate controller by wires or in a wireless manner, such as by means of Bluetooth, and a power source disposed in handgrip 38.

Figure 4:
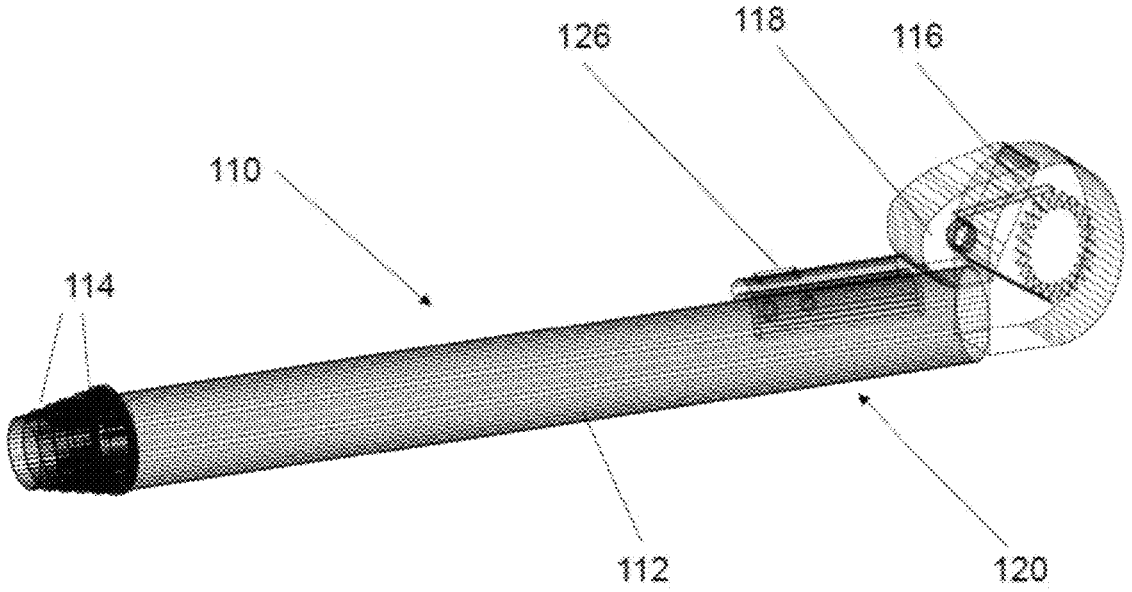
FIG. 4 is a schematic illustration of a baton constructed and operative in accordance with alternative embodiments of the present invention.
Figure 5:
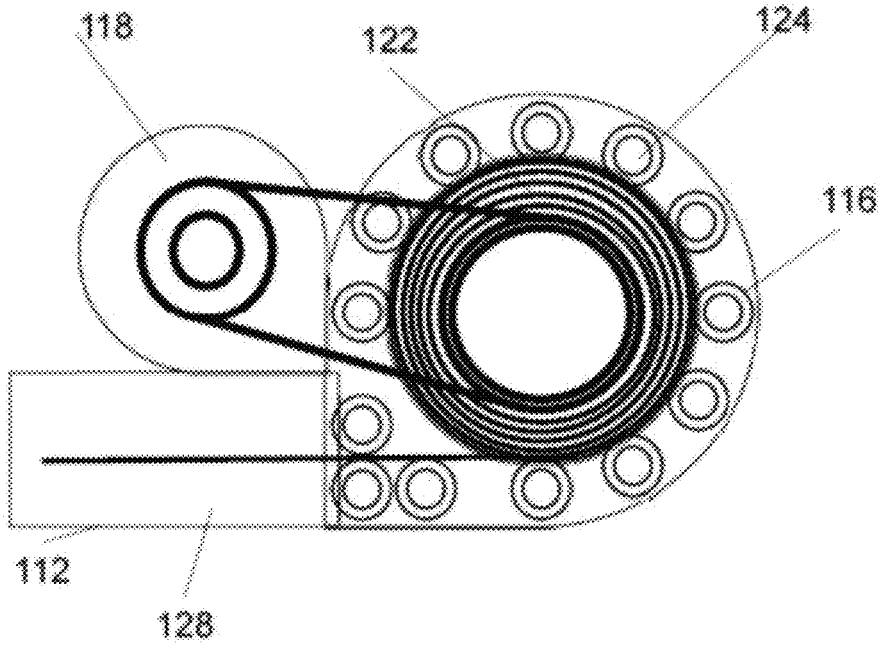
FIG. 5 is a schematic detailed view of the extension mechanism of the baton of FIG. 4.
Figure 6:
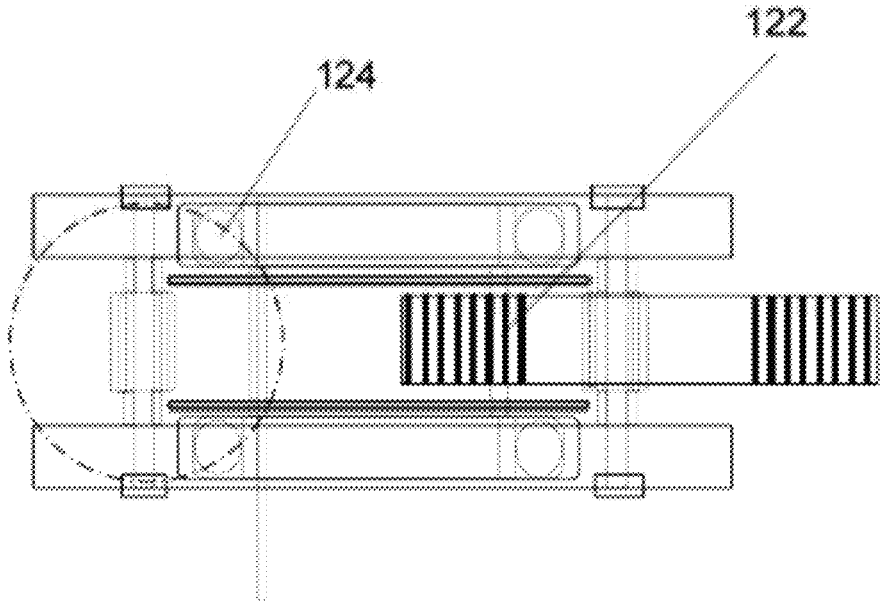
FIG. 6 is a schematic top view of the extension mechanism of the baton of FIG. 4.

An alternative embodiment of a drive mechanism 40 is illustrated in FIGS. 4, 5 and 6, schematic illustrations of an extendable weapon 110, herein illustrated and described as a baton, shown without a housing, constructed and operative in accordance with alternative embodiments of the present invention. FIGS. 5 and 6 are schematic side and top cutaway views, respectively, of a drive mechanism for extending and retracting the baton. Baton 110 includes a telescopic rod 112 formed of a plurality of telescopically interconnected rod segments 114, and a propulsion drive mechanism 120 for controlled extending and retracting of the telescopic rod. In this embodiment, the drive mechanism includes a guide member 122, which is a flat metallic strip (seen in FIGS. 5 and 6) coupled to the innermost segment 114' of the telescopic rod. Metallic strip 122 is configured to be coiled inside an inner portion of a gearing ring 116, here serving as a guide collector, when the rod is retracted. The gearing ring 116 is configured to be rotated in a first direction, in which guide member 122 is unwound and thus urged out of the gearing ring 116, extending thereby the segments 114 of the telescopic rod 112. The gearing ring 116 is further configured to be rotated in a second direction, in which the guide member 122 is urged into and wound inside the gearing ring 116, thereby retracting the segments 114 of the telescopic rod. The gearing ring 116 can include a plurality of bearings 124 configured to allow rotation thereof, as seen schematically in FIG. 5, and to push the guide member in and out of gearing ring 116. In order to increase the strength of the guide member 122 to give it sufficient stability to push and pull the rod segments, a guide curling element 128 can be provided. Guide curling element 128 can consist of a die that is flat at one end and defines a partial cylinder at the other through which the guide member 122 is drawn to shape it. In this way, when extending, the sides of the flat strip guide member are curled over the middle to create an almost cylindrical guide portion which has increased strength and stability for pushing and pulling the telescopic rod. And when retracting, the strip guide member is uncurled and flattened for winding on the guide collector. The gearing ring 116 can be rotated in the first and second directions by a motor 118, such as an electric motor, a pneumatic motor, etc. via a transmission including a belt or chain 119, as known.

Baton 110 further includes a controller 126 for controlling the length and speed of extension of the telescopic rod.

Controller 126, for example, can control the number of rotations of the gearing ring 116 and, thus, the length of the metallic strip 122 which is unwound. According to an exemplary embodiment of the invention, the gearing ring 116 is driven by a step motor, such that the number of rotations can be accurately controlled.

The controller 126 can include a manually operated slider, such that manual sliding thereof controls the operation of the motor 118. For example, moving the slider away from the user can actuate the motor to drive the gearing ring 116 to extend the telescopic rod, and moving the slider towards the user can actuate the motor to drive the gearing ring 116 to retract the telescopic rod. Preferably, a power source (not shown), such as a battery, is replaceably coupled to the controller 126 and to motor 118.

The telescopic rod 112 can be configured to receive a weapon (not shown) mounted thereon or therein, such as a knife, a Knuckle, a shocker or other electroshock weapon, etc. For example, the weapon can be mounted on the innermost segment or edge of the telescopic rod, such that outward rotation of the gearing ring 116 causes the telescopic rod to extend rapidly, so that the weapon reaches the desired target. Alternatively, or in addition, telescopic rod 112 can be configured to receive an illumination tool (not shown) mounted thereon or therein, such as a flashlight or a laser pointer. These electric tools are also operated by the controller 126. Preferably, the speed with which the telescopic rod 112 is extended provides sufficient kinetic energy to provide a strong jab to the target.

As in the embodiment of FIG. 4, the segments 114 of telescopic rod 112 may include stripes formed of a conductive material. In this case, the rod segments can be coupled to the power source in order to electrify the telescoping rod, as described above.

It will be appreciated that a combination of these drive mechanisms can be utilized. For example, the motor driving the guide member can be controlled by a transmission or by an additional motor. In this case, the rotating wheels of the embodiment of FIG. 5*a* would push the guide member out of the guide collector into the barrel and the system of FIG. 1 would return the guide member back into the guide collector.

An electroshock weapon can be provided as part of the weapon according to any of the embodiments of the invention. The electroshock weapon typically includes two electrodes, which are connected to a power source by conductors, to deliver an electric current to disrupt the voluntary control of a target's muscles, thereby causing neuromuscular incapacitation of the attacker. These electrodes would be coupled to the end member on the innermost segment of the telescopic rod. A steel spring can be provided to serve as the ground for the shocker. The electroshock weapon preferably is also controlled by the controller and powered by a capacitor coupled to the power source disposed in the housing. It will be appreciated that, since the electric shocker utilizes a capacitor that can rapidly be charged and discharged many times, there is no limit to the number of times the electric shocker can be utilized without having to replace any parts, such as cartridges, unlike conventional Tasers. For use as a Taser, two electrodes which are connected to the capacitor are mounted on the impact surface 21 (see FIG. 1) of the innermost rod segment and protrude therefrom. When these electrodes make contact with the body of a target, a circuit is closed and the target receives a shock as a result of the current flow during discharge of the capacitor. Here, as well, the electrodes are well insulated from the housing and from the remaining components of the weapon, in any known fashion.

In any of the embodiments of the invention, in order not to injure a person hit by the extending impact surface, two springs can be mounted with a pressostat or other pressure sensor that would send a signal to the controller to actuate the motor in the reverse direction when a pre-defined pressure on the impact surface is reached. A standard defining an acceptable maximum force can be set and the telescopic rod withdrawn in order to prevent unintended injury greater than that permitted by law. One example of such a power control system will now be described with reference to FIG. 7. In the illustrated embodiment, a pressure sensor 140 is mounted in the end member on innermost segment 132 of telescoping rod 130 and coupled to the impact surface 136. The force 138 acting on the impact surface 136 by the target (e.g., body of an attacker) can be measured. The controller controls the time that the force is acting on the target through control of the operation of the motor. When the measured pressure is greater than that set out in the standard (or other pre-defined reference), the sensor will transfer rapidly a signal to the controller indicating that the pressure is too high and the motor will receive a command to stop the pressure, i.e., to retract the telescoping rod. According to other embodiments of the invention, the pressure sensor 140 in the illustrated embodiment is a "pressostat"—a pressure gauge which has a switch inside its casing. At a selected pressure, the switch activates an electrical contact that stops the motor on which the pressostat is wired. It acts here as a safety system.

It will be appreciated that the weapons of the present invention can be configured to include one or more holders for a number of mechanical or electrical tools, some or all of which can be removable and replaceable, for example, an electric shocker, a flashlight, a laser pointer, a canister of tear gas, etc. In the case of canisters of pressurized tear gas or other gas, the controller actuates an electric valve on the canister to permit release of the pressurized gas. These commands can be sent over wires or in a wireless manner, such as by means of Bluetooth. In this way, a user can use the baton and another tool at the same time utilizing one hand, while his or her other hand remains free. For example, mace, mustard gas or another gas can be released from the canister and/or a flashlight can be lit by the user's hand via the controller.

Alternatively, or in addition, a camera can be mounted on the weapon, for example, in telescoping rod or in the housing, for capturing images of disrupters of the peace or criminals. Such camera could be mounted either in the body of the housing or on a periscope device (not shown) for capturing images from above a crowd. A Bluetooth or other wireless connection can be provided in the housing to permit transmission of the captured images to a central location. The weapon can further include a pointer, such as a laser pointer, facilitating aiming of the weapon at the desired target.

Thus, it will be appreciated that the weapon of the present invention can replace the conventional policeman's club or baton, electric shocker, flashlight, and laser pointed with a single weapon, making both attack and defense significantly more efficient and safer, as compared with separate conventional weapons that are used at close proximity to the target.

It will further be appreciated that the weapon of the present invention can be manufactured in different sizes and weights, depending on the anticipated user and the kinds of situations in which it is likely to be used.

While the invention has been described with respect to a limited number of embodiments, it will be appreciated that many variations, modifications and other applications of the invention may be made. It will further be appreciated that the invention is not limited to what has been described hereinabove merely by way of example. Rather, the invention is limited solely by the claims which follow.

The invention claimed is:

1. A weapon comprising:

a housing;

a telescopic rod formed of a plurality of telescopically interconnected rod segments mounted in the housing, an innermost segment of said rod segments including a replaceable end member having an impact surface;

a guide collector, mounted adjacent a distal end of the weapon;

a guide member coupled at one end thereof to the guide collector and at its other end to the innermost rod segment; and a propulsion drive mechanism, mounted in the housing, for controllably extending and retracting the guide member and thereby the telescopic rod towards a target at a distance.

2. The weapon according to claim 1, wherein the drive mechanism is operated by an electric motor.

3. The weapon according to claim 1, wherein the drive mechanism is operated by a step motor.

4. The weapon according to claim 1, wherein the drive mechanism is operated by a pneumatic motor.

5. The weapon according to claim 1, further comprising a controller for controlling the drive mechanism, and, in turn, the speed and force of extension and retraction of the telescopic rod.

6. The weapon according to claim 5, further comprising at least one weapon or tool selected from the group including: a knife, brass knuckles, a canister of mace, mustard gas or tear gas, an electroshock weapon, an illumination tool, a flashlight or a laser pointer, and a camera.

7. The weapon according to claim 6, wherein the controller is configured to control operation of all electric weapons and tools mounted in the weapon.

8. The weapon according to claim 5, further comprising wired or wireless communication means between the controller and the weapons or tools.

9. The weapon according to claim 1, wherein the rod segments are formed of a hard, sturdy, lightweight material.

10. The weapon according to claim 1, wherein the rod segments are formed of carbon.

11. The weapon according to claim 1, further comprising:

an electric power source mounted in the housing;

a capacitor coupled to the electric power source;

two electrodes disposed at the impact surface of the end member and selectively electrically coupled to the capacitor;

whereby, when the capacitor is connected to the electrodes and the electrodes touch a target, an electric circuit is closed thereby discharging the capacitor through the target.

12. The weapon according to claim 11, further comprising at least one conducting wire leading from the capacitor disposed as stripes along the outer surface of the telescoping rod, whereby portions of the rod can be electrified to deliver a shock when the segments are touched.

13. The weapon according to claim 1, further comprising a pressure sensor mounted in the impact surface to operate the drive mechanism to retract the telescopic rod when a pre-defined pressure on the impact surface is reached.

14. The weapon according to claim 13, wherein the pressure sensor includes two springs coupled to a pressostat which is coupled to a controller configured to send a signal to actuate the drive mechanism a motor to retract the guide member when the pre-defined pressure on the impact surface is reached.

15. A method for providing an impact, the method comprising:

actuating a drive mechanism to propel a telescopic rod, formed of a plurality of telescopically interconnected rod segments, by means of a guide member, where one end of the guide member is coupled to an innermost rod segment of the telescopic rod and a second end of the guide member is coupled to a guide collector;

controlling speed and force of propulsion of the guide member; and delivering an impact by an end member coupled to the innermost rod segment of the telescopic rod.

16. The method according to claim 15, further comprising retracting the innermost rod segment and the telescopic rod and collecting the guide member on the guide collector.

17. The method according to claim 15, wherein the step of delivering an impact includes delivering a jab by the impact surface of the end member.

18. The method according to claim 15, wherein the step of delivering an impact includes:

connecting a capacitor to a pair of electrodes mounted in the end member; and touching the electrodes to a target, thereby closing an electric circuit and discharging the capacitor through the target and delivering an electric shock.

19. The method according to claim 18, further comprising recharging the capacitor after each shock, so that a plurality of shocks can be delivered in a short time.

20. The method according to claim 15, further comprising causing the telescopic rod to retract when a pre-defined pressure on the impact surface is reached.

* * * * *